US006291752B1

(12) United States Patent
Vergara

(10) Patent No.: US 6,291,752 B1
(45) Date of Patent: Sep. 18, 2001

(54) DRUM SHELL STRUCTURE

(76) Inventor: Florentino S. Vergara, 1009 Arcadia #2, Arcadia, CA (US) 91007

( * ) Notice: Subject to any disclaimer, the term of this patent is extended or adjusted under 35 U.S.C. 154(b) by 0 days.

(21) Appl. No.: 09/088,396

(22) Filed: Jun. 1, 1998

Related U.S. Application Data

(63) Continuation-in-part of application No. 08/684,740, filed on Jul. 22, 1996.

(51) Int. Cl.[7] ..... G10D 13/02
(52) U.S. Cl. ..... 84/411 R; 84/104
(58) Field of Search ..... 84/104, 411 R, 84/412–415, 416–417

(56) References Cited

U.S. PATENT DOCUMENTS 4,289,056 * 9/1981 Shier ..... 84/412
5,447,087 * 9/1995 Hawes et al. ..... 84/413

* cited by examiner

*Primary Examiner*—Robert E. Nappi
*Assistant Examiner*—Marlon Fletcher

(57) ABSTRACT

A musical drum with a shell that is comprised of an inner and outer wall, which is constructed by thin material. The thin material which constructs the inner and outer walls are supported by thin strips of material housed between the inner and outer walls. The strips of material and centure strips, which construct the bearing edge of the drum, create spaced aperateres within the inner and outer walls, which allows sound waves to penetrate and resonate.

6 Claims, 4 Drawing Sheets

DRUM SHELL STRUCTURE

This is a Continuation in Part to application Ser. No. 08/684,740 filed on Jul. 22, 1996.

BACKGROUND

1. Field of Invention

The field of this invention relates to musical instruments and, more particularly, to percussion drum instruments.

2. Prior Developments

Conventional drums commonly comprise of a hollow cylindrical shell having a circular drum skin stretched taut over one or both of its ends. A clamping ring is attached to the shell to exert axial clamping force on peripheral edge areas of each drum skin, thus to clamp the drum skin to the shell.

A vibrational motion of the drum's skin(s) resulting from the striking action of a drumstick on the outer surface of a drum skin produces the musical output of the drum. The vibrational motion creates a sound wave, which travels outwardly through out the interior of the drum.

Drum shells are commonly made of wood, resulting in a relatively heavy, dense and expensive construction. Conventional plastic shells are generally heavy gage constructions having relatively thick dense walls.

A drum is disclosed in U.S. Pat. No. 5,353,674 issued Oct. 11, 1994 to Volpp and entitled "Shell Resonant Membranophone". The drum is made from bent wood and has a bridge which is cut with a 45 degree bevel at an outer end to form a bearing edge for contact with the drum head membrane. However, manufacture of the drum includes producing a cylindrical member of layered wood, which is hard to form, gluing, special sand-papering to make it smooth, and special equipment to curve and form the wood, which is expensive.

Furthermore, the 45-degree bevel edge still composes a large surface area, which is contacting the head membrane. The head membrane is therefore deadened to vibration due to the large surface area of the beveled edge. The wood material making up the outer shell causes this deadened edge. This thickened surface area can not be compromised due to the lack of support the wood provides.

SUMMARY

The present invention relates to a drum including a generally cylindrical shell having two walls and having a first upper open end and a second lower open end. A rim member is disposed on both of the first upper open end and this second lower open end of the shell. A head membrane spans over the first upper and second lower open ends of the shell and has an edge portion secured between the shell and the rim member. Said two walls have thereon two cinctures at the first upper open end and the second open end second open ends of the shell and contains a wedge shaped end-bearing edge to engage the head membrane. Tension means connect at both ends and mount to both walls adjustably securing the head membrane.

The drum additionally includes the shell having a first inner wall and a second outer wall. Both the outer and inner walls extend substantially from the upper open end to the lower open end of the shell. The tension means may include a plurality of tension lugs spaced around the periphery of the shell, and a plurality of tension rods disposed within apertures of the rim member and threadedly attached to the tension lugs.

The first cincture may be disposed between the outer and inner wall of the shell and the upper head membrane, and may have a bearing edge with approximately a 45-degree bevel. The second cincture may be disposed between the inner and outer wall of the shell and the lower head membrane and may have a bearing edge with approximately a 45-degree bevel.

The drum additionally includes vertical strips positioned between the first inner wall and second outer wall shell. Said strips are placed perpendicular to the cinctures. Said vertical strips provide support of the exterior lugs, and stretch to each the upper and lower cinctures. Preferably, the shell is formed of to obtain thin walls for contact with the drum head membrane and for producing better sound.

Furthermore, the combination of thin walls constructed with thin sturdy material, and vertical wood strips which set perpendicular to the cinctures, the drums shell is mostly comprised of space. Space meaning lack of objects, and said space resides between the inner and outer shell, and is sandwiched by the said perpendicular vertical strips. It is this space which allows the a sound wave to not only penetrate the less dense shell, but resonate between the inner and outer walls.

PREFERRED EMBODIMENT

Figure 1:
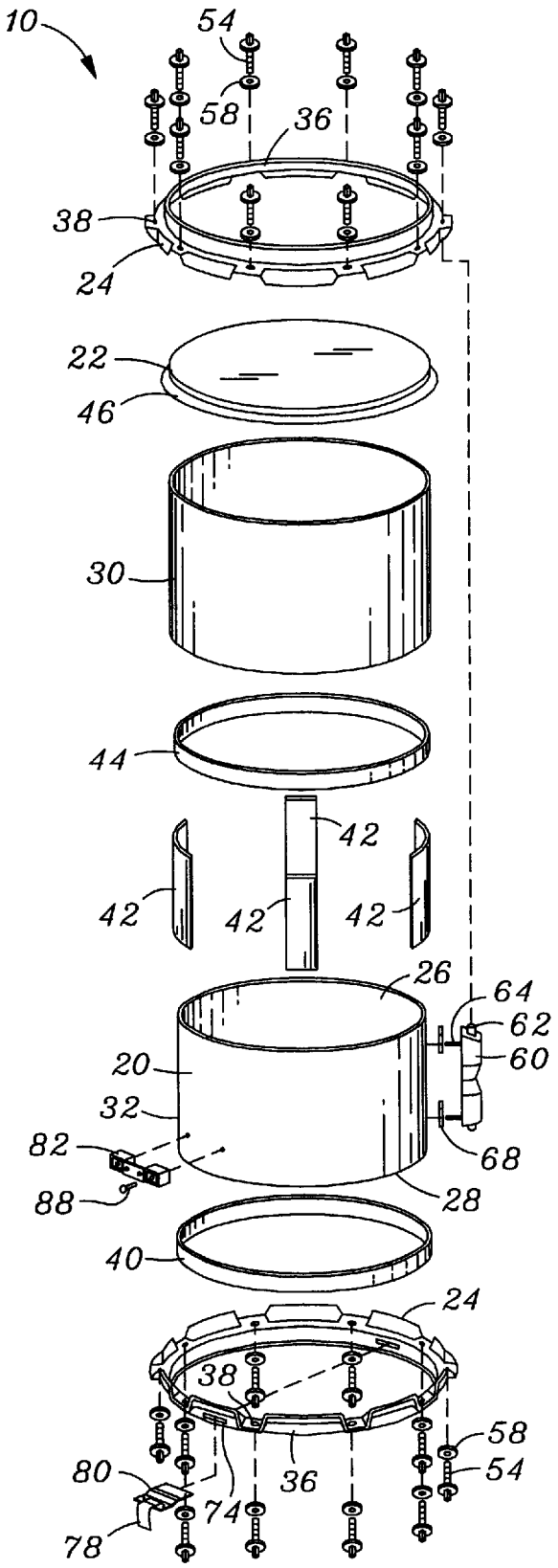
FIG. 1 is an exploded perspective view of a drum according to the present invention.

Referring to the drawings, FIG. 1 shows a drum 10 having a shell and a head membrane and a rim member 24 mounted at each end of the shell 20. The drum 10 may be a snare drum, a tom-tom, a base drum, or the like. The shell 20 is cylindrical and has a first upper open end 26 and a second lower open end 28. The shell 20 may be made from laminated plastic, wood, or any suitable material. The shell 20 includes a first or outer wall 32 covering the drum 10 and extending from each opened ends 26 and 28. The outer wall 30 is spaced apart from a second or inner wall 32, which substantially extends between each opened end 26 and 28 of the drum 10.

The thickness of the walls 30 and 32 is approximately between the range of 0.020 to 0.50 inches for providing a thin less dense obstacle for the sound wave to penetrate. The space between the inner wall 30 and outer wall 32 is the heart of this invention. Because the shell consists of an inner wall 30 and outer wall 32, with space in between said walls the sound wave can pass through the inner wall 30 and resonate in the area between the inner wall 30 and outer wall 32.

The head membrane 22 or drum skin is a stretched membrane positioned across the top and bottom of the drum 10, covering the first and second open ends 26 and 28 of the shell 20.

The rim member 24 or clamping ring has an annular wall 36 and a plurality of apertures 38 substantially evenly spaced around the perimeter of the rim member 24. The head membrane 22 is positioned between the rim member 24 and the shell 20, having the head 46 extending beyond the wall 36 for tautly stretching the head membrane 22 over the open end of the shell 20.

A pair of cinctures, such as a first cincture strip 40 and second 42, are positioned at each end of the drum 10 and are to be disposed between the inner and outer walls 30 and 32 of the shell 20 for providing the spaced apart relation of the walls. The cincture strips 40 and 42 may be formed of wood or any similar material for providing support to the shell 20 and may be approximately one inch wide by ¼ inch thick.

Pluralities of vertical strips such as vertical strip 42 are positioned between inner wall 30 and outer wall 32. These vertical strips such as 42 are positioned evenly around the cylindrical drum 10 and may coincide with the exterior tension lugs 60, of the drum 10. The said vertical strips may be formed of wood or any similar material and provide support for the external lugs 60. Said vertical strips may be vary in length and width in relation to the size of the drum 10.

Figure 2:
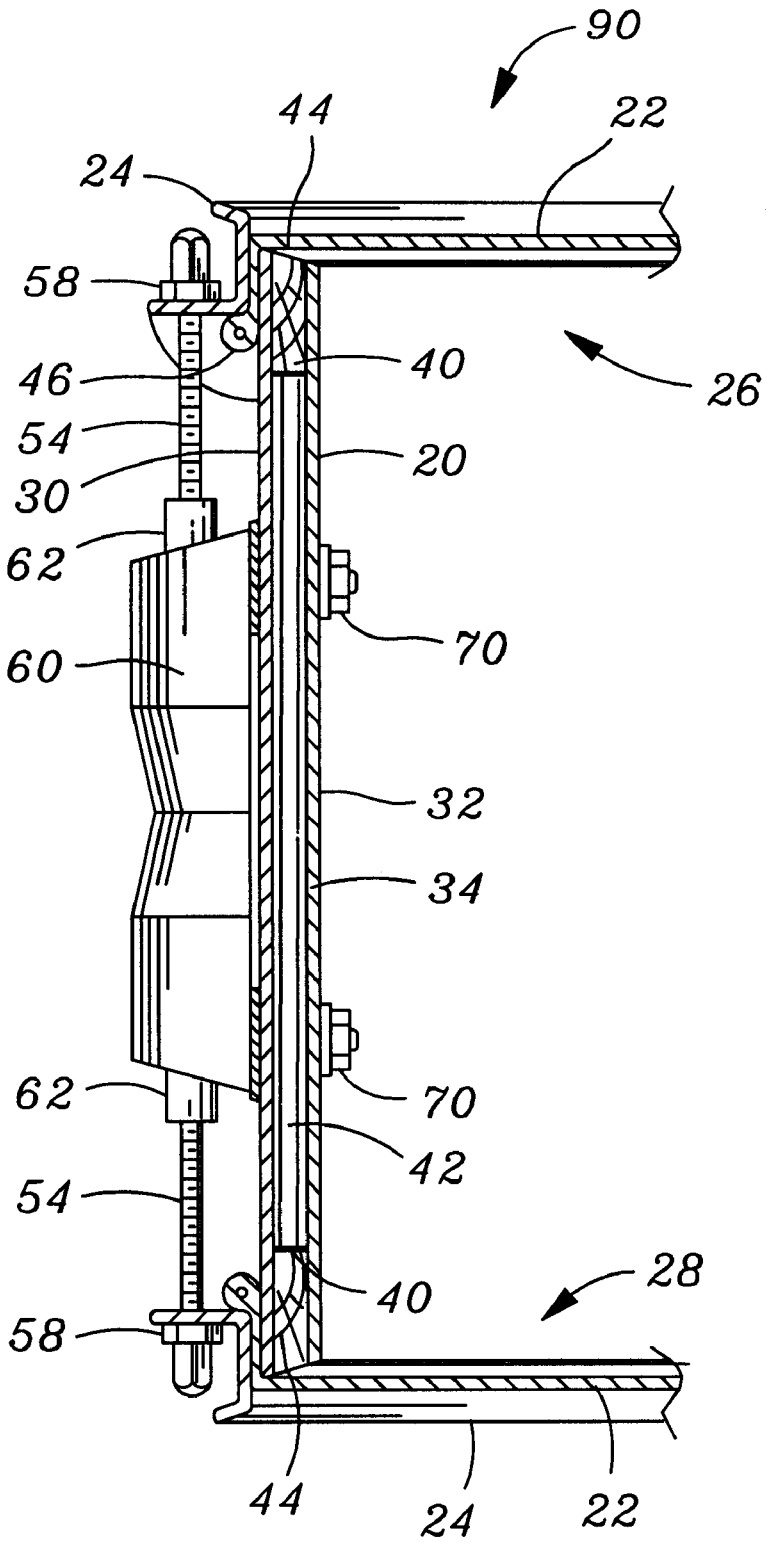
FIG. 2 is a partial sectional view of the drum showing one embodiment of the shell construction.

Referring to FIG. 2, the first cincture strip 40 has a bearing edge 44, which contacts the head membrane 22. As an example, the bearing edge 44 may be cut at approximately a 45 degree bevel angle for preventing the head membrane 22 from contacting the strip 40, while enabling the first strip 40 to be positioned at the open ends 26 and 28 of the shell 20 for providing support to the drum 90. In the event that the head membrane 22 does contact the strip 40, utilization of an angle cut or wedge shaped end bearing edge wall minimize the area of contact of the head membrane 22.

The drum 90 further includes tension means for securing the head membrane 22 to the shell 20. As an example, tension rods 54 inserted through washers 58, through apertures 38 of the rim member 24, and into tension lugs 60. The tension rods 54 have an externally threaded portion, which is inserted into the tension lugs 60, and have a square shape membrane to be used with a standard drum key. The tension lugs 60 have an internally threaded portion 62 corresponding to the externally threaded portion of the tension rods 54 for engagement of the tension rod 54 and the tension lug 60. The tension rods 54 are individually tightened to tune the drum head membrane 22 and may be removed by the 20 user to replace the drum head membrane 22.

The tension lug 60 has at least one externally threaded member for insertion of the threaded member through a washer, through the outer wall 30, through the vertical strip 42, and through the inner wall 32. A nut 70 is positioned adjacent to the inner wall 32 for securement to the threaded member extending through the inner wall 32, for attaching the tension lug 60 to the shell 20 of the drum 90. The drum 90 has a plurality of tension lugs 60 which coincide and with the vertical strips 42 evenly spaced around the perimeter of the cylindrical drum 90.

The attachment of the tension lug 60 to the vertical strips 42 prevents collapsing of the shell 20 when the screw or bolt of the tension lug 60 is tightened down to secure the tension lug 60.

For the various embodiments of this invention, the same reference characters will be used to designate like parts. In addition, like functions and like interactions of the parts among the various embodiments of this invention will not be repeated for each embodiment.

Referring to FIG. 2 and using the same reference characters to define like parts, an alliterative embodiment of the drum 10, as illustrated in FIG. 1 may be a drum 90, having like parts as drum 10, and having an outer wall 30, which substantially extends between the opposite ends of the drum 90. The inner and the outer walls 30 and 32 are positioned adjacent to one another.

Figure 3:
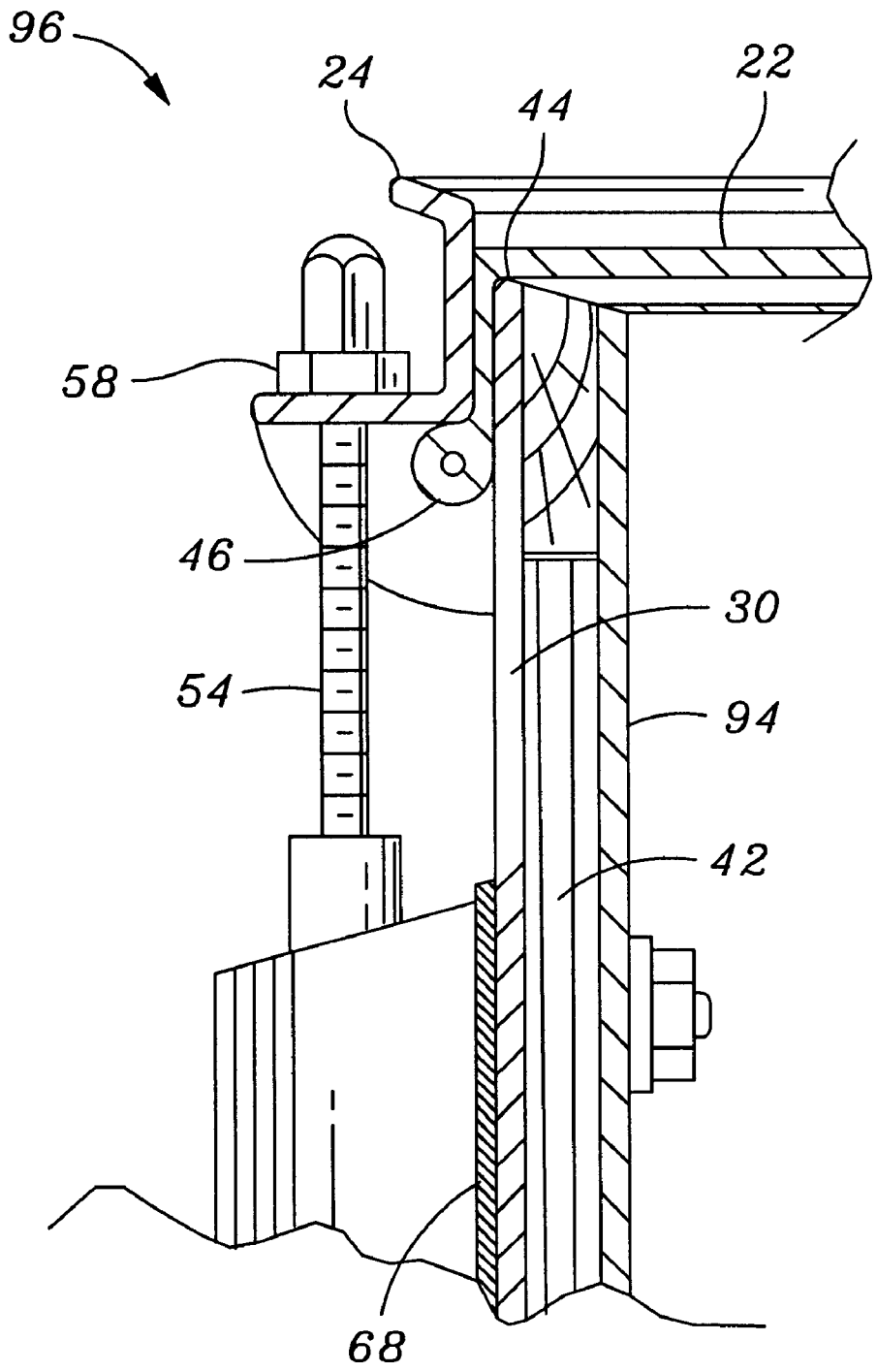
FIG. 3 is a view showing the wedge shaped end portion defining the bearing edge of the drum.

Referring to FIG. 3 and using the same reference characters to define like parts, an alliterative embodiment of the drum 96 as illustrated in FIG. 2 may be a drum 96 having like parts as drum 10 and having the inner and outer walls 30 and 32 in spaced apart relation by inserting the vertical wood strips 40 and horizontal wood strips 42 between the inner and outer walls 30 and 94. Additionally, a ring or spacer, such as the washer 68, may be positioned between the outer wall 94 and the lug 60 and aligned with each of the strips 42 for providing a space between the lug 60 and the outer wall 94.

Referring to FIG. 2, the shell 20 may be constructed of plastic laminat and has a bearing 44, which may be cutt at approximately a 45 degree bevel. The head membrane 22 contacts the bearing edge 44 of the shell 22. The drum 90 has vertical strips 42 positioned between the shell 10 and the lug 60. Alternatively, the shell 20 may be integrally formed with the strips 42 or may be glued together. The washers 68 may be positioned between the outer shell 30 and the lug 60.

An advantage of the drums 10, 90 and 96 is that it is inexpensive to manufacture. The shell 20 is formed from existing available colored, patterned plastic sheet or laminate. The vertical wood strips 42 are merely inserted between the layers of laminate, i.e. inner and outer walls 30 and 32 to provide support for exterior lugs 60. Except for the strips 42, the area between shell 30 and 32 is hollow.

The drum head membrane 22 allows the head membrane 22 to vibrate better and produce a greater sound wave if a minimal amount of surface area of the head membrane 22 contacts the shell 20 of the drum. A shell having a sharp edge or small contact area provides superior attack and sustains qualities. The sharp edge also provides a high degree of tuning response due to the head membrane movement reacting to slight tension rod adjustments. When using a wooden structure, a fairly large edge must be used, otherwise a sharp edge would break off. An advantage of the drums 10, 90 and 96 is that with a plastic laminate edge, a sharp edge can be provided which will not break off or otherwise cause a problem.

Another advantage of the drums 10, 90, and 96 is that the shell 20 includes thin walls 30 and 32. The thinner walls combined with the space between said walls make a less dense shell. Traditional drums contain a dense shell, which provides a greater resistance to a sound wave. A wooden shell cannot be made too thin or the wall will collapse. Due to the hardened plastic laminate which compose the thin walls on the drums 10, 90 and 96 the shell provides a superior transportation of a sound wave, due to minimal restrictions to the wave's path, resulting in the sound wave not being deadened.

Figure 4:
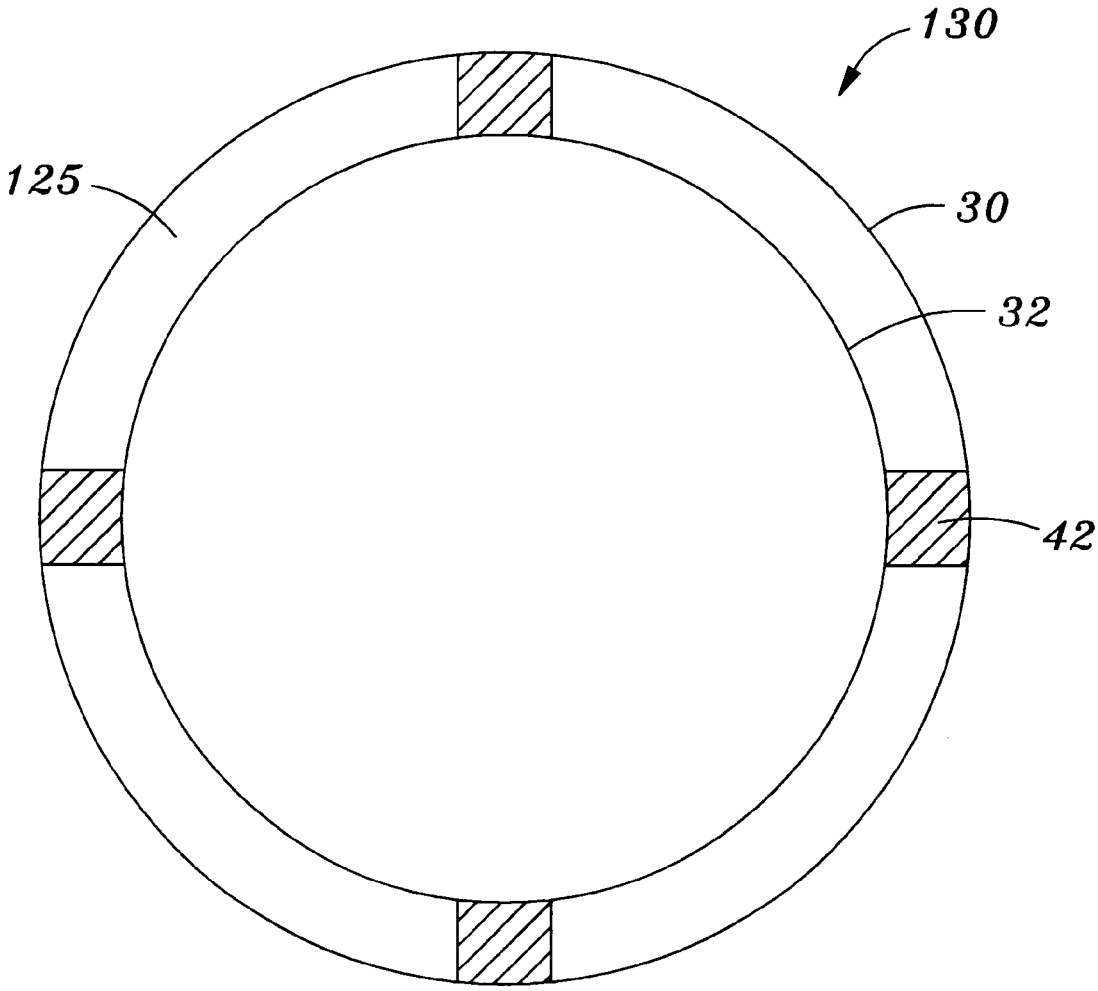
FIG. 4 is a view showing the bottom half of a cross-sectional view with no external parts attached, depicting the space between the shell's walls.

Finally, referring to FIG. 4, and using the same reference characters to define like parts, and alliterative embodiment of drum 10 illustrated in FIG. 1. Drum 130, consists of an outer shell 30, and an inner shell 32, and vertical strips 42. Figure numbers 4 also shows a space 125, which a sound wave can resonate. The said space 125 composes more amount of area than not in between the drum shells. Said space 125 also permits the drum 130, to contain an overall shell that is considerably less dense than traditional drum shells.

What is claimed is:

1. A drum wherein a shell is formed of: two walls including a first inner wall and second outer wall comprised of a thin material said two walls having thereon a cincture strip at first upper open end and a second lower and open end of the shell where the cincture strip is comprised of a wedge shaped end bearing edge to engage said head membrane.

2. A drum according to claim 1, wherein said shell is formed of said first inner wall and said second outer wall which vertical strips are housed between the first inner wall and second outer wall wherein the vertical strips add structural support for the first inner wall and second outer wall and the first upper open end and second lower open end.

3. A drum according to claim 1, wherein the cincture strip is a ring.

4. A drum according to claim 1, wherein the said vertical strips between the first inner wall and second outer wall reside perpendicular to the first upper open end and second lower open ends.

5. A drum according to claim 1, wherein said outer wall extends from the first upper open end and second lower open end of the shell.

6. A drum according to claim 1, wherein spaced apendatures are formed from the absence of material between the first inner wall and second outer wall and between the first upper open end and second lower open end and the vertical strips.

* * * * *